US007086634B1

(12) United States Patent
Kirchhoff

(10) Patent No.: US 7,086,634 B1
(45) Date of Patent: Aug. 8, 2006

(54) ADJUSTABLE KEYBOARD TRAY

(75) Inventor: Kenneth J. Kirchhoff, Gem Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 44 days.

(21) Appl. No.: 09/665,821

(22) Filed: Sep. 20, 2000

(51) Int. Cl.
*E04G 3/00* (2006.01)

(52) U.S. Cl. ..... 248/286.1; 248/918

(58) Field of Classification Search ..... 248/284.1, 248/118, 918, 286.1, 298.1, 282.1, 279.1; 108/43, 90.11, 147.11, 140, 6, 143, 5, 138; 400/715; 312/208.1, 223.3, 223.2
See application file for complete search history.

(56) References Cited

U.S. PATENT DOCUMENTS

| | | | | |
|---|---|---|---|---|
| 3,830,352 A | | 8/1974 | Kolpek | 197/186 A |
| 4,379,429 A | | 4/1983 | Gubbe et al. | 108/5 |
| 4,496,200 A | | 1/1985 | Hagstrom et al. | 312/208 |
| 4,546,708 A | | 10/1985 | Wilburth | 108/94 |
| 4,562,987 A | | 1/1986 | Leeds et al. | 248/278.1 |
| 4,616,798 A | | 10/1986 | Smeenge et al. | 248/281.11 |
| 4,625,657 A | | 12/1986 | Little et al. | 108/93 |
| 4,637,666 A | | 1/1987 | Worrell et al. | 312/196 |
| 4,644,875 A | | 2/1987 | Watt | 108/93 |
| 4,691,888 A | | 9/1987 | Cotterill | 248/284 |
| 4,706,919 A | * | 11/1987 | Soberalski et al. | 248/281.1 |
| 4,717,112 A | | 1/1988 | Pirkle | 248/639 |
| 4,736,689 A | | 4/1988 | Stanko | 108/5 |
| 4,776,284 A | | 10/1988 | McIntosh | 108/138 |
| 4,826,123 A | | 5/1989 | Hannah et al. | 248/248 |
| 4,843,978 A | | 7/1989 | Schmidt et al. | 108/138 |
| 4,844,388 A | | 7/1989 | Kuba et al. | 248/1 B |
| 4,852,500 A | | 8/1989 | Ryburg et al. | 108/105 |
| 4,863,124 A | | 9/1989 | Ball et al. | 108/28 |
| 4,880,270 A | | 11/1989 | Cooper | 297/188 |
| 4,901,972 A | | 2/1990 | Judd et al. | 248/918 |
| 4,923,259 A | | 5/1990 | Bartok | 312/208 |
| 4,931,978 A | | 6/1990 | Drake et al. | 364/708 |
| 4,938,441 A | | 7/1990 | Hannah et al. | 248/248 |
| 4,974,808 A | | 12/1990 | Ball | 248/917 |
| 4,988,066 A | | 1/1991 | Cotterill | 248/281.1 |
| 5,031,867 A | | 7/1991 | Cotterill | 248/281.1 |
| 5,037,054 A | | 8/1991 | McConnell | 248/284 |

(Continued)

FOREIGN PATENT DOCUMENTS

| | | |
|---|---|---|
| EP | 0 274 687 | 7/1988 |

OTHER PUBLICATIONS

Weber Knapp brochure and printouts from its Internet web page at www.weber-knapp.com.

(Continued)

*Primary Examiner*—Korie Chan

(57) ABSTRACT

An adjustable keyboard tray has a top and a bottom plate made of a polymeric material that are bonded together, preferably by ultrasonic welding. A cavity exists between the top and the bottom plates wherein a pocket can be formed to receive and secure a bracket for a mousing platform. The top and the bottom plates can also be formed with recessed areas to flush-mount brackets and maintain a generally overall smooth outer surface to the adjustable keyboard tray. A slidable mounting plate secures the adjustable keyboard tray to a bracketing mechanism mounted to a horizontal surface. The slidable mounting plate allows the adjustable keyboard tray to move in a lateral direction substantially perpendicular to the bracketing mechanism for repositioning the adjustable keyboard tray with respect to the horizontal surface.

26 Claims, 11 Drawing Sheets

U.S. PATENT DOCUMENTS

| | | | | | |
|---|---|---|---|---|---|
| 5,037,163 | A | | 8/1991 | Hatcher | 312/323 |
| 5,040,760 | A | | 8/1991 | Singer | 248/284 |
| 5,041,770 | A | | 8/1991 | Seiler et al. | 318/265 |
| 5,145,136 | A | | 9/1992 | McConnell | 248/284 |
| 5,158,256 | A | | 10/1992 | Gross | 248/118.3 |
| 5,203,527 | A | | 4/1993 | Rubey | 248/118 |
| 5,211,367 | A | | 5/1993 | Musculus | 248/279 |
| 5,230,289 | A | | 7/1993 | George et al. | 108/2 |
| 5,257,767 | A | | 11/1993 | McConnell | 248/284 |
| 5,292,097 | A | | 3/1994 | Russell | 248/281.1 |
| 5,294,087 | A | | 3/1994 | Drabczyk et al. | 248/639 |
| 5,342,006 | A | | 8/1994 | Tice | 248/118 |
| 5,398,896 | A | | 3/1995 | Terbrack | 248/118.5 |
| 5,405,204 | A | | 4/1995 | Ambrose | 400/472 |
| 5,413,294 | A | | 5/1995 | Greenquist | 248/127 |
| 5,509,628 | A | | 4/1996 | Noble | 248/118 |
| 5,513,579 | A | | 5/1996 | Allan | 108/93 |
| 5,628,483 | A | | 5/1997 | Smith et al. | 248/118 |
| 5,655,743 | A | * | 8/1997 | Gillis | 248/346.01 |
| 5,732,910 | A | * | 3/1998 | Martin | 248/118 |
| 5,755,410 | A | | 5/1998 | Ambrose et al. | 248/118 |
| 5,823,487 | A | | 10/1998 | Kirchhoff et al. | 348/118 |
| 5,830,552 | A | * | 11/1998 | Meier et al. | 428/68 |
| 5,832,840 | A | | 11/1998 | Woof | 108/6 |
| 5,881,976 | A | | 3/1999 | Gutowski | 248/118.5 |
| 6,003,446 | A | * | 12/1999 | Leibowitz | 108/43 |
| 6,079,676 | A | | 6/2000 | Hackett et al. | |
| 6,092,774 | A | * | 7/2000 | Choy | 248/298.1 |
| 6,279,859 | B1 | * | 8/2001 | West et al. | 248/118 |

OTHER PUBLICATIONS

Waterloo Furniture Components sales brochure and printouts from its Internet web page at www.wfeltd.com.

WorkRite Ergonomics sales brochure and assembly instructions.

Fellowes Manufacturing Company printouts from its Internet web page at www.fellowes.com.

* cited by examiner

ADJUSTABLE KEYBOARD TRAY

TECHNICAL FIELD

This invention relates to a keyboard platform. More particularly, the invention relates to an adjustable keyboard tray.

BACKGROUND OF THE INVENTION

Drastic increases in computer use have created a need to provide a platform for computer keyboards that provides various features for a computer. The platform should allow for easy access to the keyboard for use in an ergonomically correct manner, as well as allow for quick and easy storage that protects the keyboard and does not interfere with the user when the keyboard is not being used. To achieve these objectives, a plethora of keyboard platforms are commercially available. The keyboard platforms are typically secured to a bracketing mechanism that is mounted to an underside of a horizontal surface, such as a desk or a work station. The bracketing mechanism generally allows the keyboard platform to be positioned under the horizontal surface of either the desk or the work station when it is not in use. The bracketing mechanism also allows for the keyboard platform to be extended out from under the horizontal surface when a keyboard placed upon the keyboard platform is going to be used.

Bracketing mechanisms can typically adjust the height of the keyboard platform relative to the horizontal surface it is mounted to when the platform is in an extended position. This allows the user to vary the vertical positioning of the keyboard platform to a desired position while using the keyboard. It is also common for the keyboard platform to allow a small degree of tilt, so as to alter the angle of the platform supporting the keyboard rather than remain in a strictly horizontal position. Some bracketing mechanisms also allow lateral or horizontal movement in a radial direction about a pivot point located on the bracketing mechanism. However, radial rotation of the keyboard platform is of limited value because typically at least a portion of the keyboard platform will be rotated underneath the horizontal surface creating unusable space on the keyboard platform. This results because the edge of the horizontal surface is usually not aligned with the arc of rotation allowed by the bracketing mechanism. Further, the desk or work station which provides the horizontal surface may not allow the user to sit positioned perpendicular to the keyboard and the monitor in an ergonomically correct manner once the keyboard tray is radially rotated. To increase the amount of acceptable radial rotation by the keyboard platform, the bracketing mechanism would have to extend out a greater distance from the edge of the horizontal surface. This solution, however, creates stability concerns with the bracketing mechanism. As the bracketing mechanism extension increases, the bracketing mechanism can begin to exhibit undesirable bouncing or spring board type characteristics. Additionally, as the keyboard platform is moved further from the edge of the horizontal surface, maintaining a proper distance between the user and the monitor becomes difficult. Radial lateral rotation of the keyboard platform thus provides limited useful application.

Bracketing mechanisms fall into two primary types; side mount and center mount bracketing mechanisms. Side mount bracketing mechanisms typically include two arms that translate out from the horizontal surface and are connected to the keyboard tray along its sides. Center mount bracketing mechanisms typically include a single arm which translates out from the horizontal surface for connection to the keyboard tray centered on its bottom surface. Side mount, or two arm, bracketing mechanisms typically provide greater strength and stability, but also require a larger footprint for mounting to the underside of the horizontal surface (e.g., desk or table). Center mount, or single arm, bracketing mechanisms typically require a smaller footprint for mounting to the horizontal surface but can create stability problems during use when the sides of the keyboard tray deflect or teeter about the connection point between the bracketing mechanism and the keyboard platform. If the deflection of the keyboard tray can be minimized, however, center mount bracketing mechanisms can afford greater flexibility in where they are used because of their smaller mounting footprint.

Keyboard platforms also come in various sizes. There are keyboard platforms large enough to accommodate a keyboard and mouse on a single surface. Single platforms are typically 26 inches to 28 inches wide and require a clearance area of about 28 to 30 inches on the underside of the horizontal work station or desk. Work stations and desks, however, are becoming increasingly smaller, making the clearance area required to utilize the keyboard platform of greater significance. To decrease the required clearance area, two-tiered keyboard platforms that mount a smaller, separate mousing platform to a larger keyboard platform are available. The mousing platform can be secured to the keyboard platform by various techniques, such as surface mounting a bracket to either the bottom or side of the keyboard platform, surface mounting the mousing platform itself to the keyboard platform, or sandwiching a plate between the keyboard platform and a securing bracket, so that the plate can either rotate or slide out from underneath the keyboard platform to provide the mousing surface on either the left or right side. Two-tier keyboard platforms are typically more narrow than the single piece platforms and are about 18 inches to 20 inches in width. Two-tier platforms thereby increase the versatility with which they can be used by decreasing the clearance area they require.

Stability is another factor that affects the quality and performance of a keyboard platform. Stability refers primarily to deflection and damping. Deflection relates to the amount of bounce or spring experienced in the keyboard platform when the keyboard or mouse supported by the keyboard platform is used. Deflection is a greater concern for keyboard platforms secured to center mount bracketing mechanisms because of the single mounting point at the center of the keyboard platform. Keyboard platforms secured to center mount bracketing mechanisms experience the greatest deflection when weight is placed on the side areas of the keyboard platform. Damping relates to the time period it takes the keyboard platform to return to a rest position once it is deflected. It is desirable to decrease the time it takes the keyboard platform to return to its rest position and limit the time that the keyboard platform remains in a bouncing state. Weight is another consideration for the keyboard platform. The heavier a keyboard platform is, the harder it will be to initially mount to the horizontal surface or adjust its position during use once mounted. Weight may also affect the type of bracket mechanism that can be used and possibly damage either the desk, working station or other horizontal surface on which it is mounted.

Further considerations regarding a keyboard platform include durability and convenience. Keyboard platforms must be durable to withstand bumps and jars from being pushed and pulled in and out of position as well as being hit by office furniture, other equipment, the user or other office personnel. Keyboard platforms also should be convenient to use and avoid injuring the user or damaging the user's clothing.

To achieve the desired objectives, many keyboard platforms are constructed from particle board that is machined to shape and then finished with a vinyl covering added to the top and sides. A recent trend has been to utilize a phenolic resin in the construction of the board used for the keyboard platform to increase the board's strength and rigidity. Particle board keyboard platforms, while very rigid, are also heavy and tend to include sharp edges on the bottom surface that chip away over time. Particle board and phenolic resin keyboard platforms also require surface mounting any additional items or features to the keyboard platform, such as the mousing platform. Unfortunately, surface mounting items to the keyboard platform can create additional sharp edges and corners that can scratch and injure the user or snag and damage the user's clothing.

Plastic keyboard platforms have recently been introduced to overcome the weight and expense of producing particle board keyboard platforms. There are two primary types of plastic keyboard platforms. The first type uses two plastic plates that are secured together by a set of screws. The two plastic plates are approximately one-quarter to one-half inch thick. The second type of plastic keyboard platform is a single piece of plastic that is approximately two inches thick with an open bottom and a rib network that supports the top surface. Plastic keyboard platforms typically weigh less and are less expensive to produce than the particle board or phenolic resin keyboard platforms. Plastic keyboard platforms, however, continue to require surface mounting of items to the bracketing mechanism and the mousing platform which can create more sharp edges. Another drawback of plastic keyboard platforms is that they lack sufficient rigidity to prevent bouncing or deflection during use.

Deflection or bouncing of the keyboard platform affects keying and mousing accuracy achievable by the user. This in turn increases the stress level experienced by the user and causes strain on the operator's arm and shoulder as the user holds their arms up rather than resting them on the keyboard platform or mouse platform. Deflection, or bounce, can be illustrated by placing a five pound weight (which approximates the weight associated with the use of a mouse by a user's hand) on the outer edge of a keyboard platform that is secured to a bracketing mechanism mounted underneath a horizontal surface. The keyboard tray is tested when it is extended out from under the horizontal surface. The five pound weight is placed on either the left or right side along the outer edge, approximately half way between the front and back of the keyboard tray, to simulate the affect of mouse use on the keyboard tray. If the keyboard tray includes a mousing platform, then the five pound weight is placed on the outer side edge of the mousing platform. For example, a standard single arm, center mounted style of bracketing mechanism such as the Advantage Arm, Part No. 21149, offered by Weber Knapp, Co., Jamestown, N.Y., or comparable type of bracketing mechanism could be used to mount the keyboard platform to the horizontal surface. A keyboard platform of this type should preferably not deflect more than a quarter to a half of an inch at its outer edge when the five pound weight is added.

Testing different types of keyboard trays can illustrate the different qualities associated with each type of board. An AKT 100 series board manufactured by Minnesota Mining and Manufacturing Company, St. Paul, Minn. was tested, which is a vinyl covered particle board type of keyboard tray. This keyboard platform deflected approximately one half inch when a five pound weight was placed on its surface. However, the particle board keyboard platform tested weighed approximately 4.3 pounds, making it heavy and a little difficult to handle. The particle board keyboard platform also had sharp edges along its bottom surface and where the mouse platform is surface mounted to the keyboard platform.

A sheet metal type of keyboard tray manufactured by Weber Knapp Co., and identified as the 24783 Set was also tested. The sheet metal keyboard tray was thinner than the particle board keyboard tray, but weighed approximately 6.3 pounds. When the five pound weight was added, the sheet metal type keyboard tray deflected approximately one and a quarter inches at its outer edge, or beyond the desired quarter inch to half inch range. Thus, the sheet metal keyboard tray exhibited significant deflection and thus less stability than the particle board keyboard tray.

Plastic keyboard trays were also tested. The first type of plastic keyboard platform tested utilized two plastic plates secured together with a series of screws similar to the 6200 and 6400 series product lines offered by Waterloo Furniture Components Limited, Kitchener, Ontario. The actual model tested was a 6421 keyboard tray with a surface mounted pocket attached to the keyboard tray that receives and secures therein a bracket supporting the mouse platform. When a five pound weight was added, the two plastic plates secured by screws exhibited significant deflection of approximately two inches and at times the five pound weight fell off of the mousing platform altogether. The design therefore did not achieve the stability of the particle board keyboard platform or remain within the desired quarter inch to half inch level of deflection.

The second type of plastic keyboard platform tested uses a single piece of plastic and is produced by Fellowes, Itasca, Ill., as product number FEL-93810. This keyboard tray also exhibited significant deflection of approximately one and a half inches when a five pound weight was added. Additionally, the single piece of plastic included many deep ribs located on its open bottom side and had a thickness of approximately two inches to try and increase the board's stiffness. The ribs, however, also increased the number of sharp edges along the bottom of the keyboard tray as well as increased the keyboard tray's thickness, without maintaining a range of deflection within the desired quarter inch to half inch range.

There is thus no known solution to provide a stable, substantially smooth bottomed, light weight keyboard platform utilizing a central mount bracketing mechanism.

SUMMARY OF THE INVENTION

The invention relates to an adjustable keyboard tray for use with a center mount bracketing mechanism. The adjustable keyboard tray comprises of a top and a bottom plate that are secured together, preferably by ultrasonic welding. A cavity is formed between the top and the bottom plates once they are secured together. A series of inner walls extend from the opposed facing sides of the top and the bottom plates. The series of inner walls create a pocket along a side of the adjustable keyboard tray that can be accessed through an opening in the side of the adjustable keyboard tray that is aligned with the pocket. The pocket can receive and secure therein a mouse bracket to which a mouse platform is secured. The adjustable keyboard tray further includes a mounting plate that secures the adjustable keyboard tray to the bracketing mechanism. The mounting plate is preferably secured to the adjustable keyboard tray along the bottom plate by a retaining bracket that has a central opening. The retaining bracket is secured to the bottom plate in a manner which creates a pair of channels therebetween that secures the mounting plate therein and allows the mounting plate to slide thereon. The retaining bracket is preferably secured to the bottom plate in a recessed mounting area to maintain a substantially smooth, flat surface across the adjustable keyboard tray. The mounting plate is secured to the bracketing mechanism through the central opening of the retaining bracket. The mounting plate is fixedly secured to the bracketing mechanism and allowed to slide along the channels created between the retaining bracket and the bottom plate, allowing the adjustable keyboard tray to be repositioned in a substantially lateral and perpendicular direction to the bracketing mechanism.

BRIEF DESCRIPTION OF THE DRAWINGS

The present invention will be further explained with reference to the attached figures, wherein like structure is referred to by like numerals throughout the several views.

While the above-identified drawing figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1:
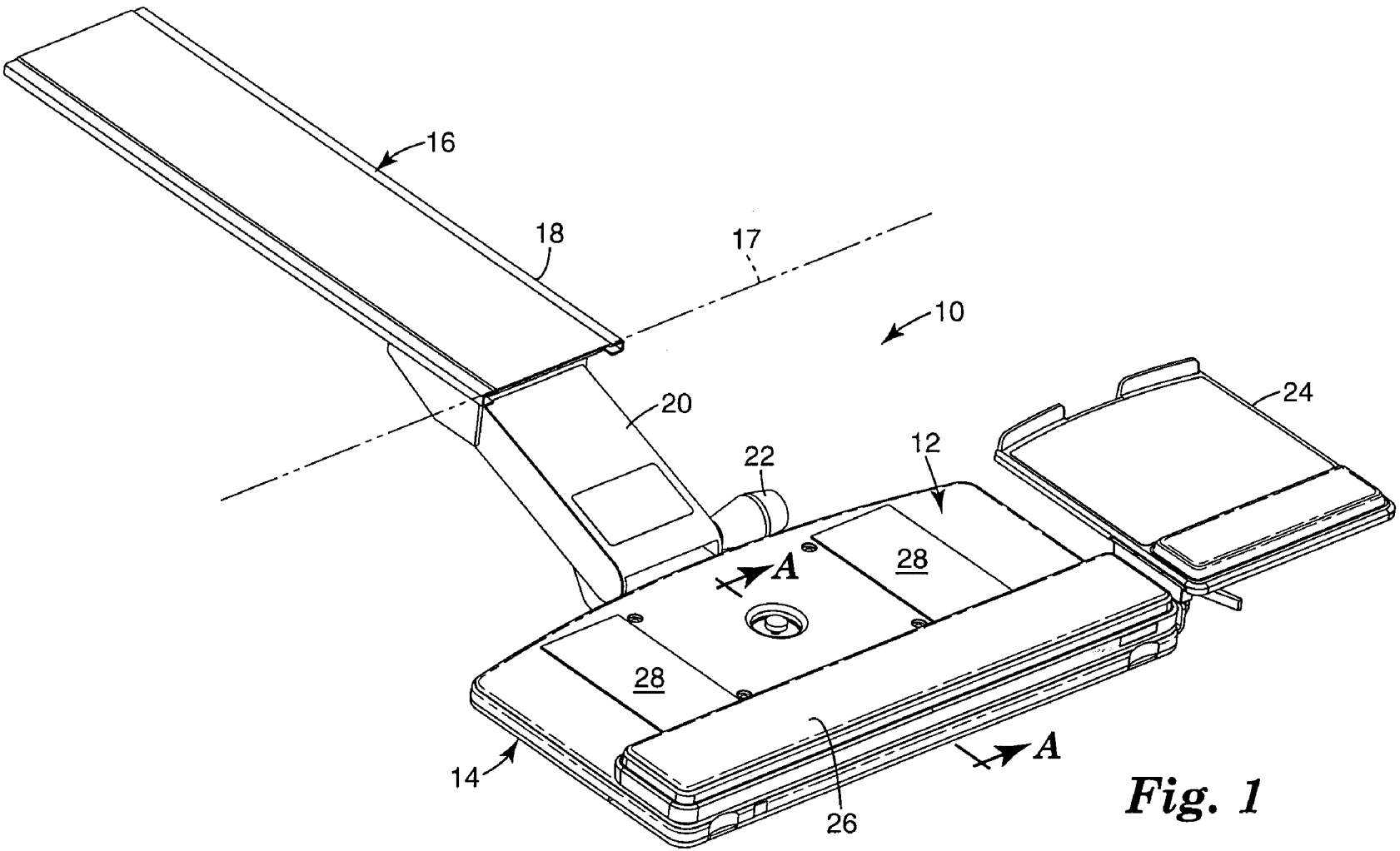
FIG. 1 is a perspective view of a first preferred embodiment of the adjustable keyboard tray invention.

A preferred embodiment of an adjustable keyboard tray 10 is illustrated in FIG. 1. The adjustable keyboard tray 10 comprises a top plate 12 and a bottom plate 14, both of which are made of a polymeric material and are bonded together, preferably by ultrasonic welding. The adjustable keyboard tray 10 is designed for use with and is secured to a center mount bracketing mechanism 16. The bracketing mechanism 16 is secured to the bottom plate 14 of the adjustable keyboard tray 10 at one end and typically to an underside of a horizontal surface at an opposite end. The horizontal surface is not shown in FIG. 1, but is generally either a desk, table or work station. However, it could also include other types of furniture or stands as well.

The bracketing mechanism 16 allows for substantially lateral movement that is generally perpendicular to a front edge 17 (shown in phantom in FIG. 1) of the horizontal surface. The front edge 17 is illustrated as a straight line for reference purposes, but it could also have a "V" shape, such as in corner work stations, or any other desired shape. The bracketing mechanism 16 thus allows the adjustable keyboard tray 10 to be positioned under the horizontal surface when a keyboard (not shown in FIG. 1) is placed upon the top plate 12 and is not in use. Alternatively, the bracketing mechanism 16 can be pulled or extended out beyond the front edge 17 and thus out from under the horizontal surface for access to the keyboard when a user is operating a computer connected to the keyboard.

The bracketing mechanism 16 shown in FIG. 1 utilizes a slide type of mechanism that includes a slide track 18 and an arm assembly 20. The slide track 18 is secured to the underside of the horizontal surface and provides tracks or channels that the arm assembly 20 slides upon. The arm assembly 20 also typically includes a locking lever 22. The locking lever 22 can be released to allow pivoting of the arm assembly 20 for adjusting the vertical height of the bracketing mechanism 16, and hence the adjustable keyboard tray 10 and keyboard (relative to the horizontal surface). While the bracketing mechanism 16 shown incorporates a sliding type of mechanism, alternative types of bracketing mechanisms can also be used and the particular style of the bracketing mechanism is not germane to the invention.

The top plate 12 and the bottom plate 14 are preferably made of a polymeric material. The top and the bottom plates 12 and 14 are preferably formed from high impact polystyrene resin, although a medium impact polystyrene resin is also acceptable. The top and the bottom plates 12 and 14 are preferably constructed by an injection molding technique that is well known to one of ordinary skill in the art. The polymeric material results in the adjustable keyboard tray 10 being light weight and economical to produce. One example of an adjustable keyboard tray 10 of the invention weighs approximately 3.4 pounds. The light weight nature of the adjustable keyboard tray 10 limits the stress and strain placed upon the bracketing mechanism 16, and thus in turn the stress and strain placed upon the underside of the horizontal surface that the bracketing mechanism 16 is mounted to. This is advantageous by not only reducing the wear and break down of the underside of the horizontal surface where the bracket mechanism 16 is mounted, but the lighter weight of the adjustable keyboard tray 10 also makes it easier to secure the keyboard tray 10 to the bracket mechanism 16 mounted under the horizontal surface. Adjusting the vertical height of the keyboard tray 10 once it is secured to the bracketing mechanism 16 by use of the locking lever 22 is also easier due to the lighter weight of the adjustable keyboard tray 10.

The adjustable keyboard tray 10 also preferably includes a mouse platform 24, a wrist rest 26 and a non-slip surface 28. The mouse platform 24 provides an area to store and operate a mouse. The wrist rest 26 is preferably included to maintain proper positioning of the user's wrists while typing on the keyboard. The non-slip surface 28 can be created on the polymeric material itself during the injection molding process, (e.g., etched into the top plate) or can be formed by non-slip pads secured to the top plate 12. The non-slip surface 28 helps prevent the keyboard placed upon the top plate 12 of the adjustable keyboard tray 10 from slipping or sliding during use, or while the tray 10 is moved from one position to another.

Figure 2:
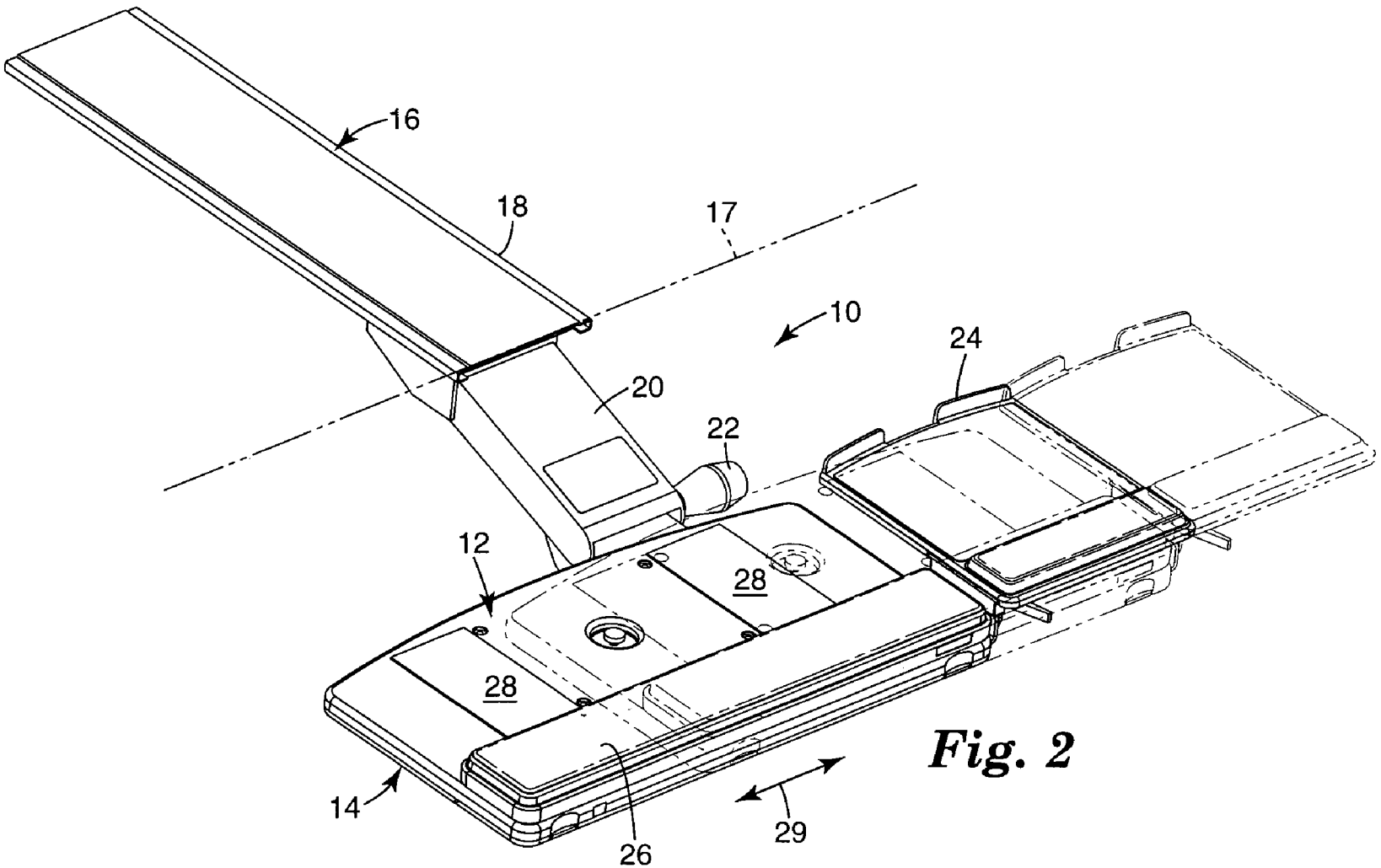
FIG. 2 is a perspective view illustrating lateral adjustment of the first preferred embodiment of the invention.

The adjustable keyboard tray 10 also provides its own lateral adjustment in a generally perpendicular direction to the bracketing mechanism 16, or in a substantially parallel direction to the front edge 17 of the horizontal surface. The perpendicular lateral movement provided by the adjustable keyboard tray 10 is illustrated in FIG. 2 by arrows 29 that indicate the direction of movement by the keyboard tray 10. The solid outline of the adjustable keyboard tray 10 illustrates its position at its left-most limit, while the broken line outline of the adjustable keyboard tray 10 illustrates its position at its right-most limit (both relative to the bracketing mechanism 16). As a further point of reference, the adjustable keyboard tray 10 in FIG. 1 is shown approximately centered about the bracketing mechanism 16 and thus centered about its range of lateral movement as well.

The ability of the adjustable keyboard tray 10 to move in a lateral direction (perpendicular to the lateral movement of the bracket mechanism 16 and parallel to the front edge 17 of the horizontal surface) allows the user to maintain proper ergonomic positioning of the keyboard placed upon the adjustable keyboard tray 10. The keyboard tray 10 provides lateral adjustment while maintaining the keyboard and mouse substantially perpendicular to the computer monitor (not shown), which is generally placed on top of the horizontal surface, within the confines of the desk or work station that provides the horizontal surface. The perpendicular lateral movement provided by the keyboard tray 10 also allows lateral adjustment without repositioning the keyboard tray 10 underneath the horizontal surface. The lateral movement also simplifies the positioning and mounting of the bracket mechanism 16 to which the adjustable keyboard tray 10 is secured. By allowing fine lateral adjustments of the tray in use, the exact mounting location of the bracket mechanism 16 on the underside of the horizontal surface is not as critical. Thus, the perpendicular lateral movement makes it easier and quicker to secure the bracketing mechanism 16 to the underside of the horizontal surface.

Figure 3:
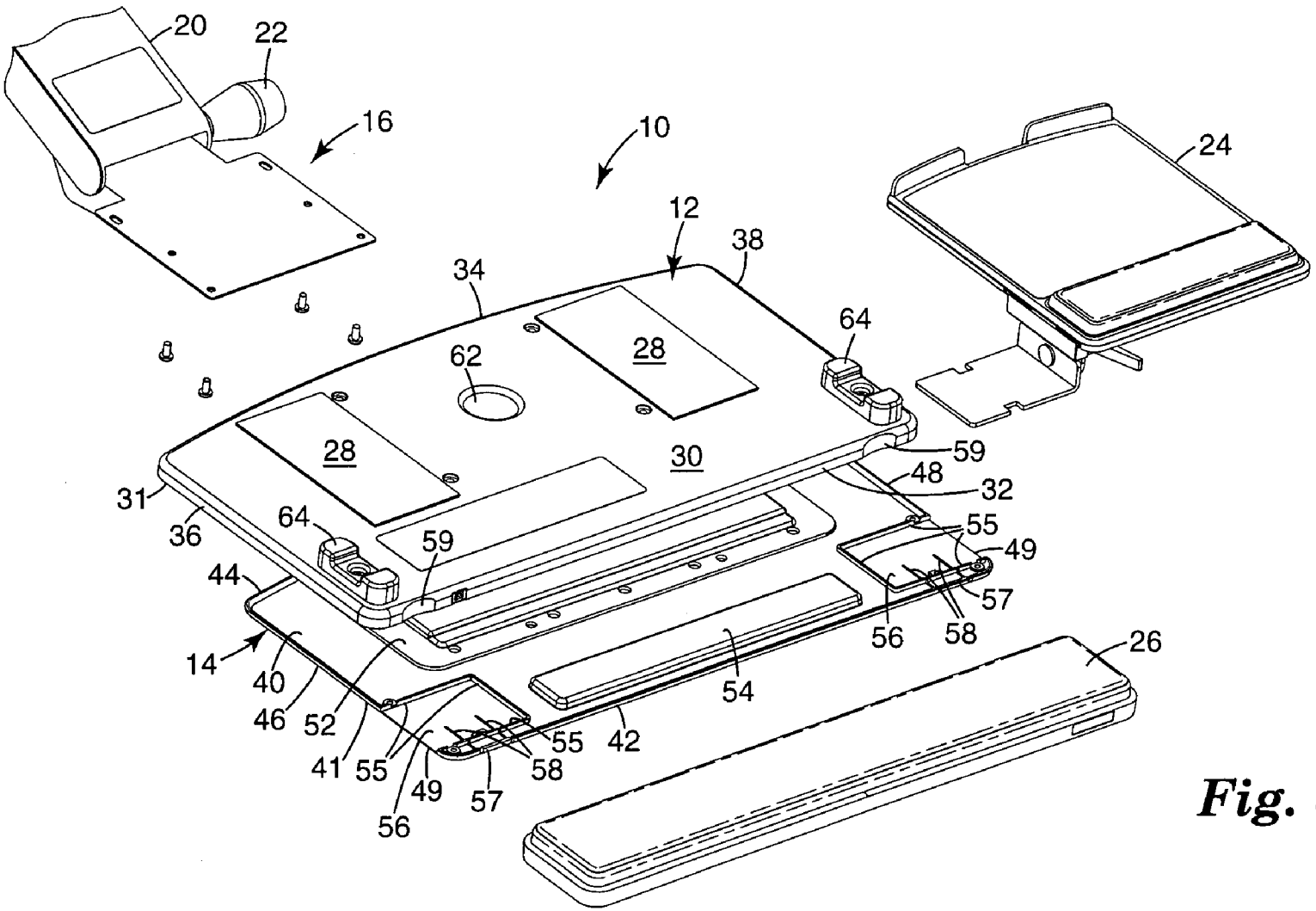
FIG. 3 is an exploded view of the first preferred embodiment of the invention.

The top and the bottom plates 12 and 14, respectively, are more clearly shown in an exploded, perspective view of the adjustable keyboard tray 10 that is illustrated in FIG. 3. The top plate 12 further includes generally a top surface 30 and a bottom surface 31 (more clearly shown in FIG. 8) with a set of walls at a front 32, a back 34 and opposing sides 36 and 38. The walls 32–38 preferably extend substantially perpendicularly downward from the top surface 12. The edges at the transition from the top surface 30 to the walls 32–38 are preferably rounded as are the corners between the intersecting walls 32–38. The rounded corners help prevent injury to the user who may contact an otherwise sharp edge and helps prevent chipping or breaking off a portion of the edge or the top plate 12 if something contacts the edge or the top plate 12.

The bottom plate 14 similarly includes a top surface 40 and a bottom surface 41 from which a set of walls at a front 42, a back 44 and opposing sides 46 and 48 extend. However, the set of walls 42–48 extend upward from the top surface 40 of the bottom plate 14 as illustrated in FIG. 3. The top surface 40 of the bottom plate 14 is set below or is recessed from an edge created by the walls 42–48 as illustrated in FIG. 3. The top and bottom plates 12 and 14 generally have the same overall shape, and their respective front walls 32 and 42, back walls 34 and 44, and opposed side walls 36, 38 and 46, 48, align and contact each other to create a generally continuous smooth outer appearance when secured together. A cavity 50 is created between the top plate 12 and the bottom plate 14 when their respective walls 32–38 and 42–48 are secured together (see FIG. 6).

A cavity 50 exists between the bottom surface 31 of the top plate 12 and the top surface 40 of the bottom plate 14. The depth of the cavity 50 is determined by the height of the walls 32–38 (or the distance they extend downward from the top plate 12) in combination with the height of the walls 42–48 (or the distance they extend upward from the bottom plate 14). By constructing the top and the bottom plates 12 and 14 out of polymeric material with an injection molding technique, recessed features can be incorporated into either or both of the top or the bottom plates 12 and 14. The adjustable keyboard tray 10 therefore does not need surface mounting brackets to either connect the adjustable keyboard tray 10 to the bracketing mechanism 16 or add other features such as the mouse platform 24. The depth of the cavity 50 can vary over the adjustable keyboard tray 10 depending upon the number and depth of recessed features placed in either the top plate 12 or the bottom plate 14. However, the exterior of the adjustable keyboard tray 10 can maintain a generally smooth continuous surface which can minimize injuring the user or snagging the user's clothing from sharp edges or corners that are created by surface mounting brackets or components.

Some of the recessed features could include a mounting area 52 and a handle 54 that are illustrated in the bottom plate 14 in FIG. 3. Similarly, an inner wall 55 that extends up from the top surface 40 of the bottom plate 14 and into the cavity 50 can be used to create an inner pocket 56. A break in the side walls 46 and 48 creates an opening 49 that is aligned with the pocket 56 to allow access therein from outside of the adjustable keyboard tray 10. The pocket 56 also creates an internal means for securing the mouse platform 24 to the adjustable keyboard tray 10, thereby avoiding the need to surface mount the pocket or mouse bracket to the adjustable keyboard tray 10 and create sharp edges or corners. For each pocket 56, a release lever 57 is created in the bottom plate 14 by preferably cutting or forming a pair of slits 58 through the bottom plate 14. The release lever 57 assists in disconnecting the mouse platform 24 from the pocket 56. An indentation 59 is placed in the front wall 32 of the top plate 12 adjacent each pocket 56 to provide easier access to its respective release lever 57.

The keyboard wrist support 26 is preferably separable from the keyboard tray 10 and sits on top of the top surface 30 of the top plate 12. A pair of wrist support mounting blocks 64 are secured to or formed in the top surface 30 of the top plate 12 to maintain the keyboard wrist support 26 in place. A thumb screw 60 (shown in FIGS. 6 and 12) is also preferably included and passes through a recessed through hole 62 in the top plate 12. The thumb screw 60 is used to lock the keyboard tray 10 in place once it is properly positioned, thereby preventing further lateral movement relative to the bracketing mechanism 16, as illustrated in FIG. 2. The recessed through hole 62 allows the thumb screw 60 to pass through the top plate 12 to lock the keyboard tray 10 in place.

Figure 4:
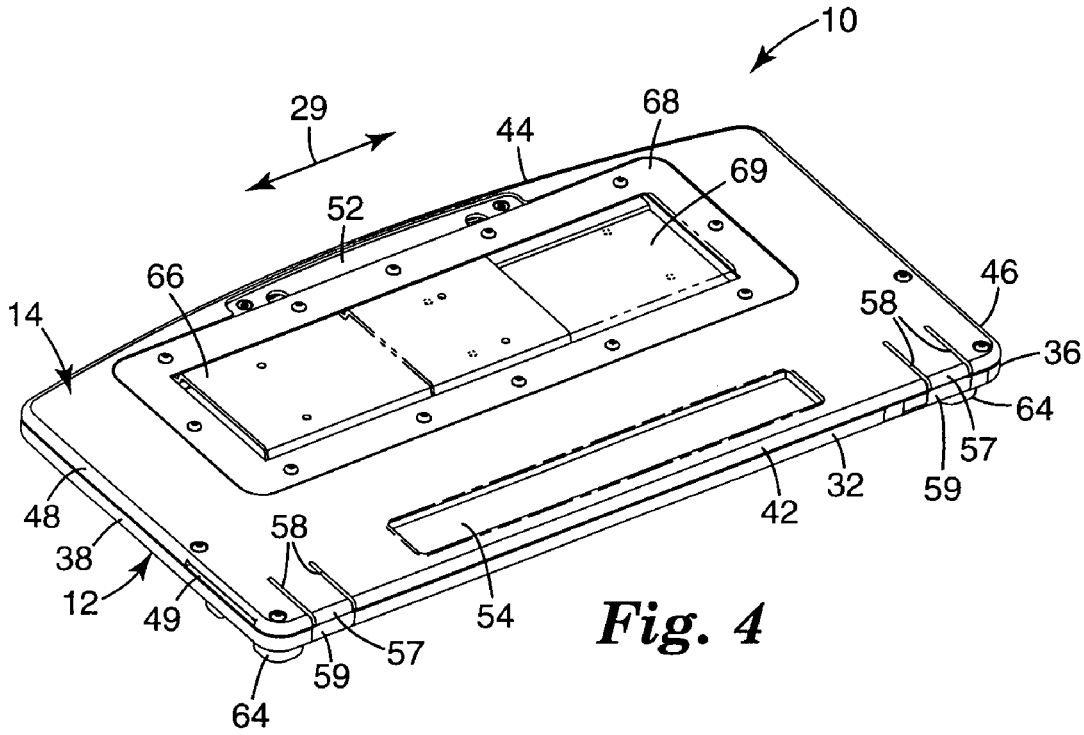
FIG. 4 is a bottom perspective view of the first preferred embodiment of the invention.

A bottom perspective view of the preferred embodiment of the adjustable keyboard tray 10 is illustrated in FIG. 4. The adjustable keyboard tray 10 in FIG. 4 has been flipped over or rotated 180° (side over side) from its orientation in FIGS. 1–3. Thus, the pair of side walls 36, 38 and 46, 48 of the top plate 12 and the bottom plate 14, respectively, are reversed from their orientation in FIGS. 1–3. However, the front walls 32 and 42 remain in the foreground of the illustration and the back walls 34 and 44 remain in the background of the illustration.

FIG. 4 more clearly shows the ability of the present invention to create recessed areas, such as for the handle 54 or the mounting area 52, to enhance the adjustable keyboard tray 10 by making it easier, more convenient, and comfortable to use. The recessed handle 54 makes it easier for the user to positively grasp the adjustable keyboard tray 10 when either pulling it out from a stored position under the horizontal surface, or returning it to a stored position after use from an extended position. In a preferred embodiment, the mounting area 52 is recessed to accommodate a slidable mounting plate 66 that is maintained therein by a retaining bracket 68 having a central opening 69. The recessed feature of the mounting area 52 allows the retaining bracket 68 to be secured to the adjustable keyboard tray 10 flush with the bottom surface 41 of the bottom plate 14. The ability to flush mount the retaining bracket 68 with the bottom surface 41 maintains a generally smooth and continuous surface across the bottom of the adjustable keyboard tray 10. This is important because the bottom surface typically contacts or brushes against the top or front of the user's thighs as they move about under the adjustable keyboard tray 10 and the horizontal surface.

FIG. 4 also illustrates how the lateral movement of the adjustable keyboard tray 10 relative to the bracketing mechanism 16 is achieved. The perpendicular lateral movement is achieved with the slidable mounting plate 66 which is secured to the arm assembly 20 of the bracketing mechanism 16. The slidable mounting plate 66 is maintained in the mounting area 52 of the bottom plate 14 by the retaining bracket 68. The slidable mounting plate 66 is maintained between the mounting area 52 of the bottom plate 14 and the retaining bracket 68. By mounting the slidable mounting plate 66 in this fashion, the slidable mounting plate 66 is allowed to slide the length of the central opening 69 in the retaining bracket 68, or the length of the mounting area 52.

The extent of perpendicular lateral movement is illustrated in FIG. 4. Again, arrows 29 illustrate the direction that the slidable mounting plate 66 can move. The range of movement is shown by the solid line depiction of the slidable mounting plate 66 (which shows the slidable mounting plate at its limit closest to the side walls 38 and 48), and the depiction of the slidable mounting plate 66 in phantom (which shows the slidable mounting plate 66 at its opposite limit closest to the side walls 36 and 46). The solid line depiction of the slidable mounting plate 66 closest to the side walls 38 and 48, corresponds to the solid line depiction of the adjustable keyboard tray 10 in FIG. 2. Likewise, the phantom view of the slidable mounting plate 66 closest to the side walls 36 and 46 in FIG. 4, corresponds to the phantom view of the adjustable keyboard tray 10 depicted in FIG. 2.

Figure 6:
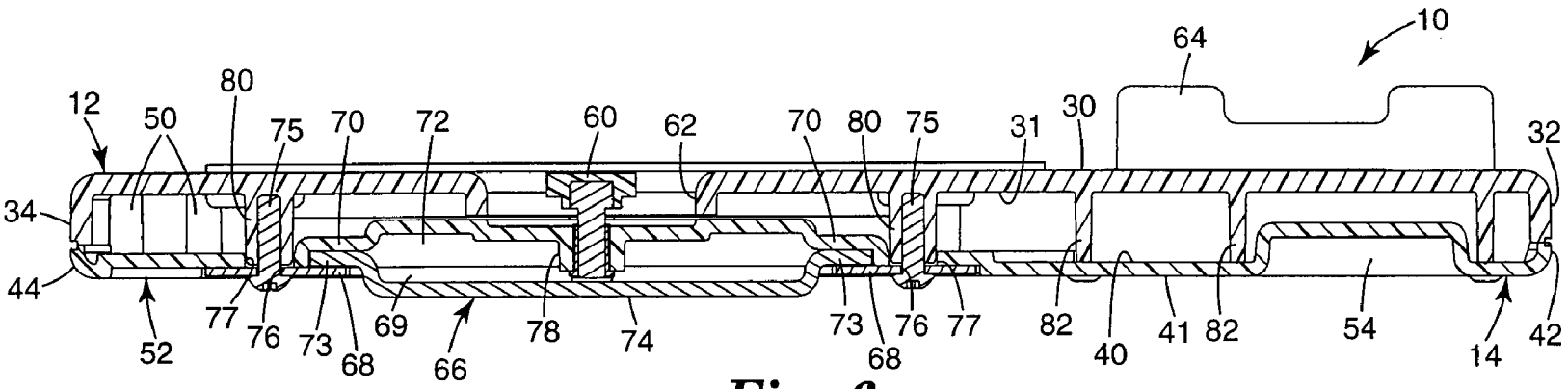
FIG. 6 is a sectional view as taken along lines A—A in FIG. 1.

In the preferred embodiment, the amount of perpendicular lateral movement is dependant upon the difference in length between the central opening 69 in the retaining bracket 68 and the length of the slidable mounting plate 66. This is because, in a preferred embodiment, the slidable mounting plate 66 will extend slightly out though the central opening 69 in the retaining bracket 68. As shown in FIG. 6, the slidable mounting plate 66 extends just beyond the bottom surface 41 of the bottom plate 14. This prevents the arm assembly 20 from rubbing along either the retaining bracket 68 or the bottom surface 41 (between the retaining bracket 68 and the back wall 44), when the adjustable keyboard tray 10 is secured to the arm assembly 20 and laterally moved perpendicular to the bracketing mechanism 16. In a preferred embodiment, the slidable mounting plate 66 extends less than a quarter of an inch beyond the retaining bracket 68 or the bottom surface 41 of the bottom plate 14 to avoid the creation of sharp corners or edges that result from surface mounting.

The difference in length between the central opening 69 in the retaining bracket 68 and the slidable mounting plate 66 is preferably approximately four inches. The perpendicular lateral movement of the adjustable keyboard tray 10 is therefore also approximately four inches, which allows sufficient repositioning to accommodate left or right hand mouse users of the adjustable keyboard tray 10. This is especially important when the adjustable keyboard tray 10 is secured to a bracketing mechanism 16 that extends from a corner unit of a work station or from a "cutout" work station where the bracketing mechanism 16 is mounted off center from the horizontal surface (relative to the monitor) in order to provide sufficient clearance for the mouse platform 24 to extend out from the keyboard tray once the keyboard tray is extended. The adjustable keyboard tray 10 eliminates having to remount the bracketing mechanism 16 whenever left and right handed users switch locations, especially in corner or cut away stations. Instead, the bracketing mechanism 16 can be approximately center mounted and then the perpendicular lateral movement allowed by the present invention can be used to properly position the adjustable keyboard tray 10.

Figure 5:
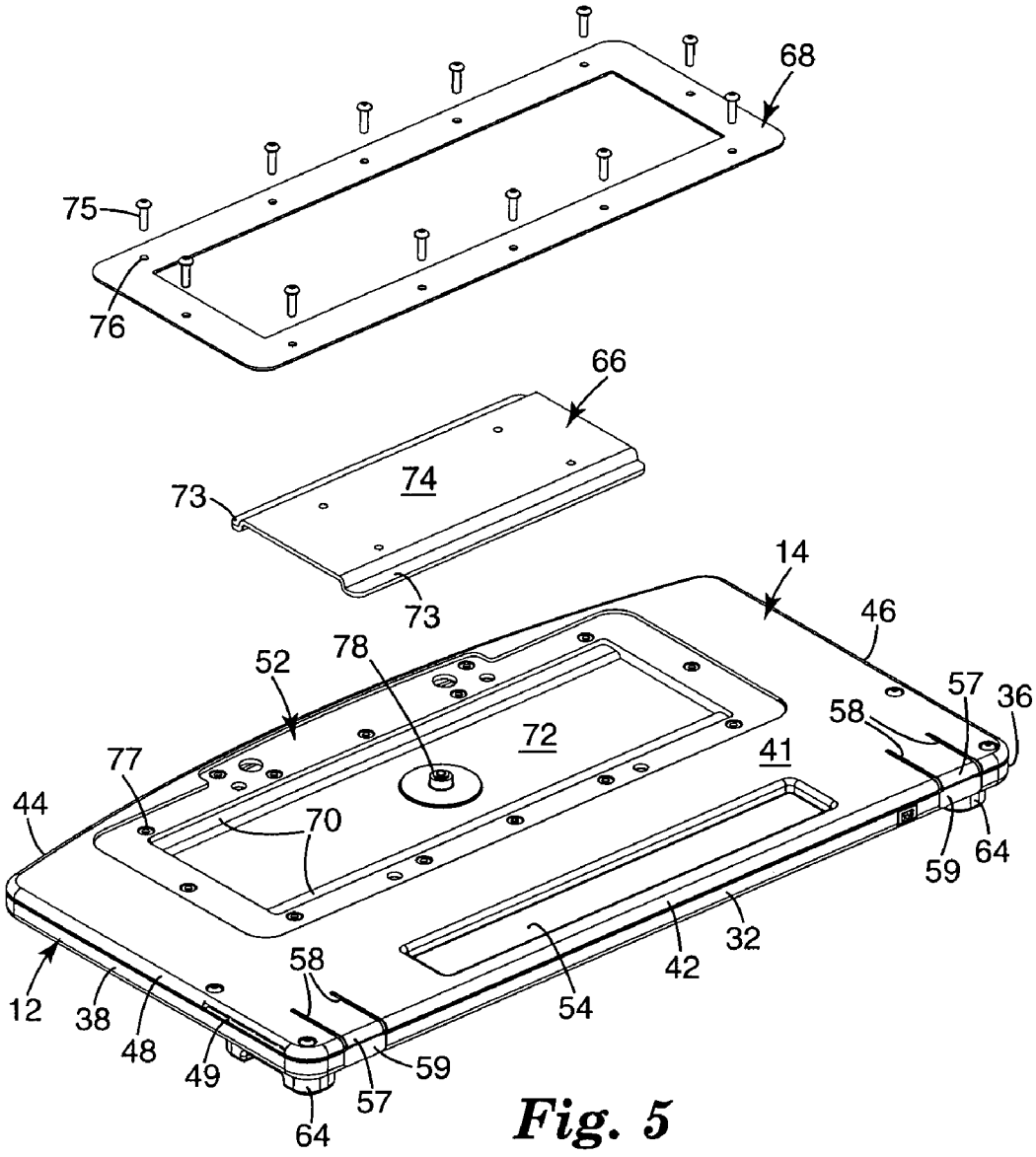
FIG. 5 is an exploded, bottom perspective view of the first preferred embodiment of the invention.

FIG. 5 is an exploded bottom perspective view of the adjustable keyboard tray 10. The adjustable keyboard tray 10 is oriented similar to the manner depicted in FIG. 4 to illustrate how the slidable mounting plate 66 is preferably maintained in the mounting area 52 by the retaining bracket 68. The recessed mounting area 52 preferably includes a pair of opposed facing rails 70 that run along the lateral length of a sunken section 72. The sunken section 72 is recessed below the mounting area 52, which is itself recessed from the bottom surface 41 of the bottom plate 14 in order to receive the retaining bracket 68 flush with the bottom surface 41 when the retaining bracket 68 is secured thereto.

The slidable mounting plate 66 preferably includes a pair of raised lateral flanges 73 along its length. The pair of raised flanges 73 extend out and are parallel to the slidable mounting plate's 66 mounting surface 74. The pair of raised flanges 73 are captured in a channel created by the rails 70 and the retaining bracket 68 once the retaining bracket 68 is secured in the mounting area 52 in the bottom plate 14. The channel, or space between the rails 70 and the retaining bracket 68 is greater than the thickness of the flanges 73 and thus provides sufficient clearance for the flanges 73 to freely slide along the channel and provide the lateral movement of adjustable keyboard tray 10 perpendicular to the bracketing mechanism 16.

The retaining bracket 68 is preferably secured in the mounting area 52 and against the bottom plate 14 by a plurality of fasteners 75 that pass through pre-drilled through holes 76 in the retaining bracket 68 and a corresponding set of through holes 77 formed in the mounting area 52 of the bottom plate 14. The fasteners 75 are preferably socket driven screws to prevent any burs from forming on the screw heads when they are driven into place, which typically occurs when either a slotted or phillips screw head is used. However, it is well know by one of ordinary skill in the art that other fastening techniques, including a slotted or phillips screws or rivets, could alternatively be used to secure the retaining bracket 68 against the bottom plate 14.

The sunken section 72 also includes a threaded bore 78 for receiving the thumb screw 60. The thumb screw 60 (accessible from the recessed through hole 62 in the top plate 12) is driven through the threaded bore 78 and into the recessed sunken section 72 until its end contacts the slidable mounting plate 66. The thumb screw 60 is then tightened, causing its end to contact and press against the slidable mounting plate 66, thereby locking the plate 66 in place relative to the bottom plate 14. The thumb screw 60 thus acts as a set screw to prevent lateral movement of the adjustable keyboard tray 10 once it has been properly positioned in a desired location. In this embodiment, the length of the slidable mounting plate is at least half of the length of the central opening 69. This ensures that at least a portion of the slidable mounting plate 66 will be beneath the threaded bore 78 so that the thumb screw 60 can contact the slidable mounting plate 66 and secure it in place. One skilled in the art will recognize that other known techniques to secure the slidable mounting plate 66 can also be used. These techniques can include, for example, a shorter length slidable mounting plate with multiple threaded bores 78 or a threaded bore 78 that is secured into and can slide along a slot.

FIG. 6 is a sectional view of the adjustable keyboard tray 10 taken along line A—A from FIG. 1. The mouse platform 24 and the keyboard wrist support 26 have been removed for clarity of illustration. The sectional view more clearly illustrates the cavity 50 created between the top plate 12 and the bottom plate 14 when the plates are secured together. By injection molding polymeric material to form the top and the bottom plates 12 and 14, respectively, many of the necessary features such as the manner the keyboard tray is secured to the bracketing mechanism can be recessed into the cavity 50 in order to create a thinner keyboard tray with a generally continuous smooth outer surface such as the adjustable keyboard tray 10 illustrated in FIG. 6.

FIG. 6 also more clearly shows that the mounting area 52 is recessed to receive the retaining bracket 68 so that once the bracket 68 is secured against the bottom plate 14, the bracket 68 is flush with the bottom surface 41. As illustrated in FIG. 6, the retaining bracket 68 is secured against the bottom plate 14 by a plurality of fasteners 75 that pass through a plurality of pre-drilled holes 76 that correspond and align with the though holes 77 in the bottom plate 14. The fasteners 75 are then received into a plurality of threaded bores or sockets 80 that extend down from the bottom surface 31 of the top plate 12. The sockets 80 are aligned with the through holes 77 and pre-drilled holes 76. Ribs 82 also extend down from the bottom surface 31 of the top plate 12 to create inner walls within the cavity 50 for added support and rigidity to the adjustable keyboard tray 10. The channels created by the retaining bracket 68 and the rails 70 of the sunken section 72, along with the raised flanges 73 slidably captured therein, are also more clearly shown. FIG. 6 further shows that the sunken section 72 provides sufficient clearance for the mounting hardware required to secure the slidable mounting surface 74 of the mounting plate 66 to the arm assembly 20 (not shown) of the bracketing mechanism 16 through the central opening 69.

Figure 7:
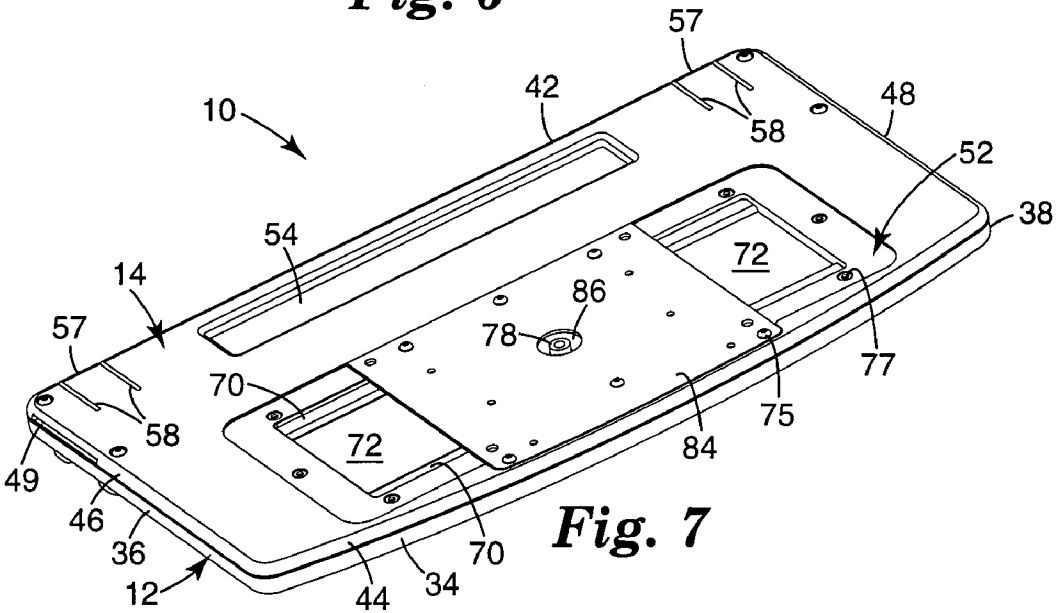
FIG. 7 is a bottom perspective view of a second preferred embodiment of the adjustable keyboard tray invention, wherein the tray has a fixed mounting bracket secured thereto.

FIG. 7 is a bottom perspective view of a second embodiment of the adjustable keyboard tray 10 of the present invention, with a standard mounting plate 84 secured in the mounting area 52 of the bottom plate 14. The adjustable keyboard tray 10 illustrated in FIG. 7 has been flipped or rotated upside down 180° end over end as compared to the views provided in FIGS. 1–3, rather than about its sides as illustrated in FIGS. 4–5. Thus in FIG. 7, the back walls 34 and 44 of the top and bottom plates 12 and 14, respectively, are at the leading edge of the figure as depicted. As illustrated in FIG. 7, the mounting area 52 preferably includes a recessed area for the standard mounting plate 84, as well as for the slidable mounting plate 66. By so forming, the standard mounting plate 84, if used, is recessed into the mounting area 52, similar to the slidable mounting plate 66, and maintains a flush or generally continuous smooth bottom with the bottom surface 41 of the bottom plate 14. The standard mounting plate 84 also includes a hole 86 that is aligned with the threaded bore 78. The hole 86 is a clearance hole for the threaded bore 78. The thumb screw 60 is not used with the standard mounting plate 84.

Figure 8:
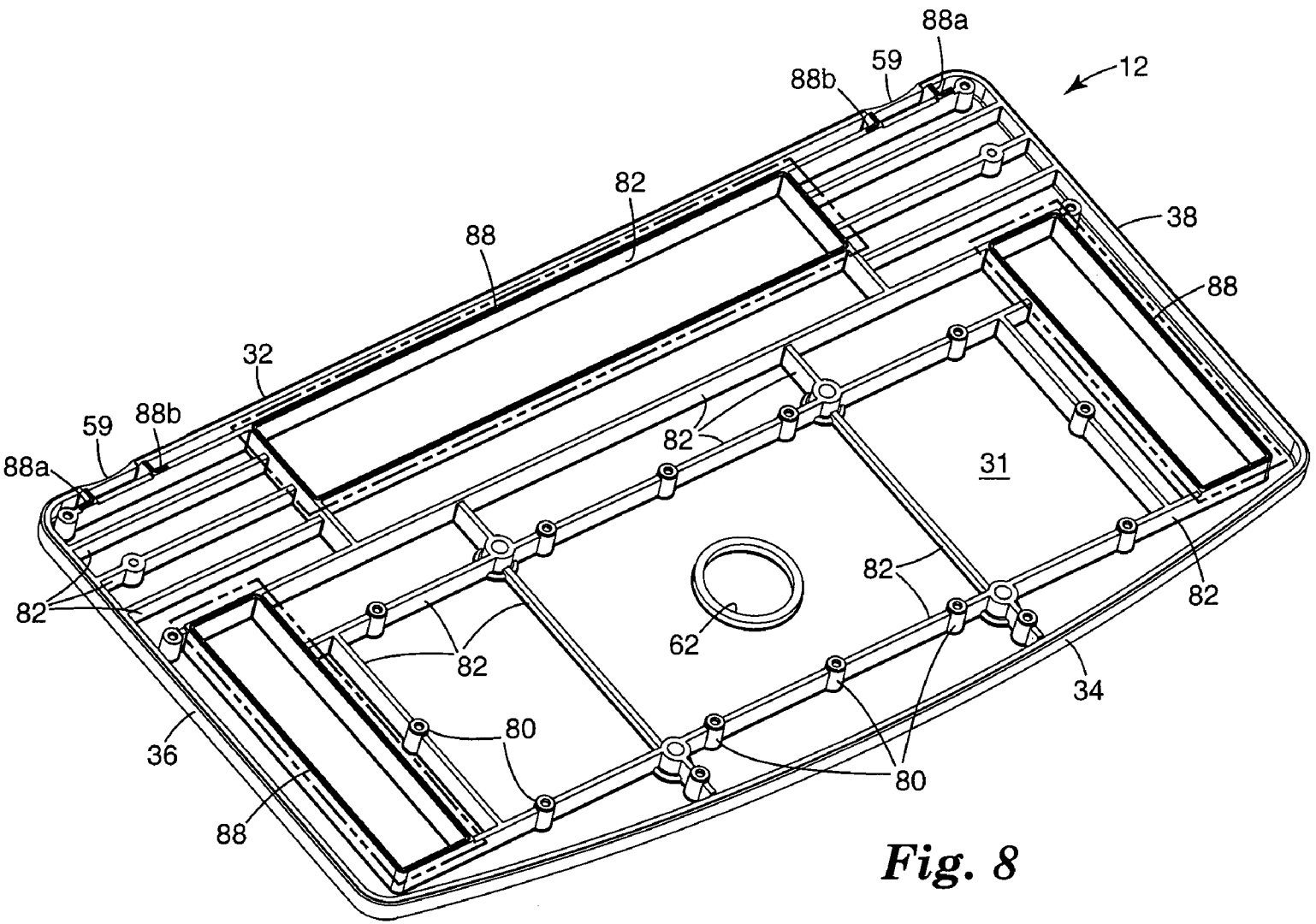
FIG. 8 is a perspective view of a bottom surface of a top plate of the keyboard tray platform in preferred embodiments of the invention.

FIG. 8 illustrates a perspective view of the bottom side 31 of the top plate 12. FIG. 8 more clearly shows the bottom surface 31 and an example of the network of ribs 82 or inner walls that extend therefrom to provide strength and rigidity to the top plate 12 and stability to the adjustable keyboard tray 10. The plurality of sockets 80 that are aligned to receive the fasteners 75 are also shown, and are preferably formed in alignment with one or more of the ribs 82.

Of particular interest in FIG. 8, however, is a series of darkened areas 88 atop certain ribs 82. Each darkened area 88 has also been enclosed with a broken line to assist in its identification. The darkened areas 88 represent the preferred locations to ultrasonically weld the top and bottom polymeric plates 12 and 14 together. By ultrasonically welding the top and bottom plates 12 and 14 together, the polymeric material used to construct the adjustable keyboard tray 10 is bonded together and provides significantly improved stability. The improved stability is achieved via decreased deflection and bounce of the keyboard tray, especially in comparison to commercially available keyboard trays when a mouse platform is attached to the keyboard tray and used in a laterally extended position. The improved stability is demonstrated by the defection caused by a five pound weight (that approximates the weight associated with mouse activity) placed on the edge of the mouse platform 24 that is laterally extended. The adjustable keyboard tray 10 deflected less than approximately a half of an inch when the five pound weight was added. Similarly, by providing a stronger and more rigid keyboard tray, the adjustable keyboard tray 10 also helps improve damping of any deflection or bounce that may occur. By bonding the top and bottom polymeric plates 12 and 14 together with ultrasonic welding, the adjustable keyboard tray 10 provides a light weight relatively thin yet highly stable surface to place and operate a keyboard and mouse.

The darkened areas 88 are preferred for ultrasonic welding because they provide a sufficiently large area to create a solid bond between the top and bottom plates 12 and 14, respectively, and are spaced from the outer edges of the adjustable keyboard tray 10. Ultrasonic bonding (at darkened areas 88*a* and 88*b*) are also provided adjacent each of the indents 59 for added support at a location that will experience stress during operation of its respective release lever 57. Ultrasonic welding is preferably avoided along outer walls 32–38 in order to maintain a rounded, clean, smooth uniform fit at the juncture of the top and bottom plates 12 and 14. Ultrasonically welding along either the inner walls 55, the ribs 82, or other inner surface, rather than the outer edges, also helps avoid rough or sharp edges from forming along the outer edges of the adjustable keyboard tray 10 that could either harm the user or the user's clothing. While ultrasonic welding is the preferred technique to bond the top and bottom plates 12 and 14 together, those skilled in the art will recognize that other techniques (such as adhesives, fasteners, solutions, or other bonding agents or slurries) can be used as well without departing from the spirit and the scope of the invention.

Figure 9:
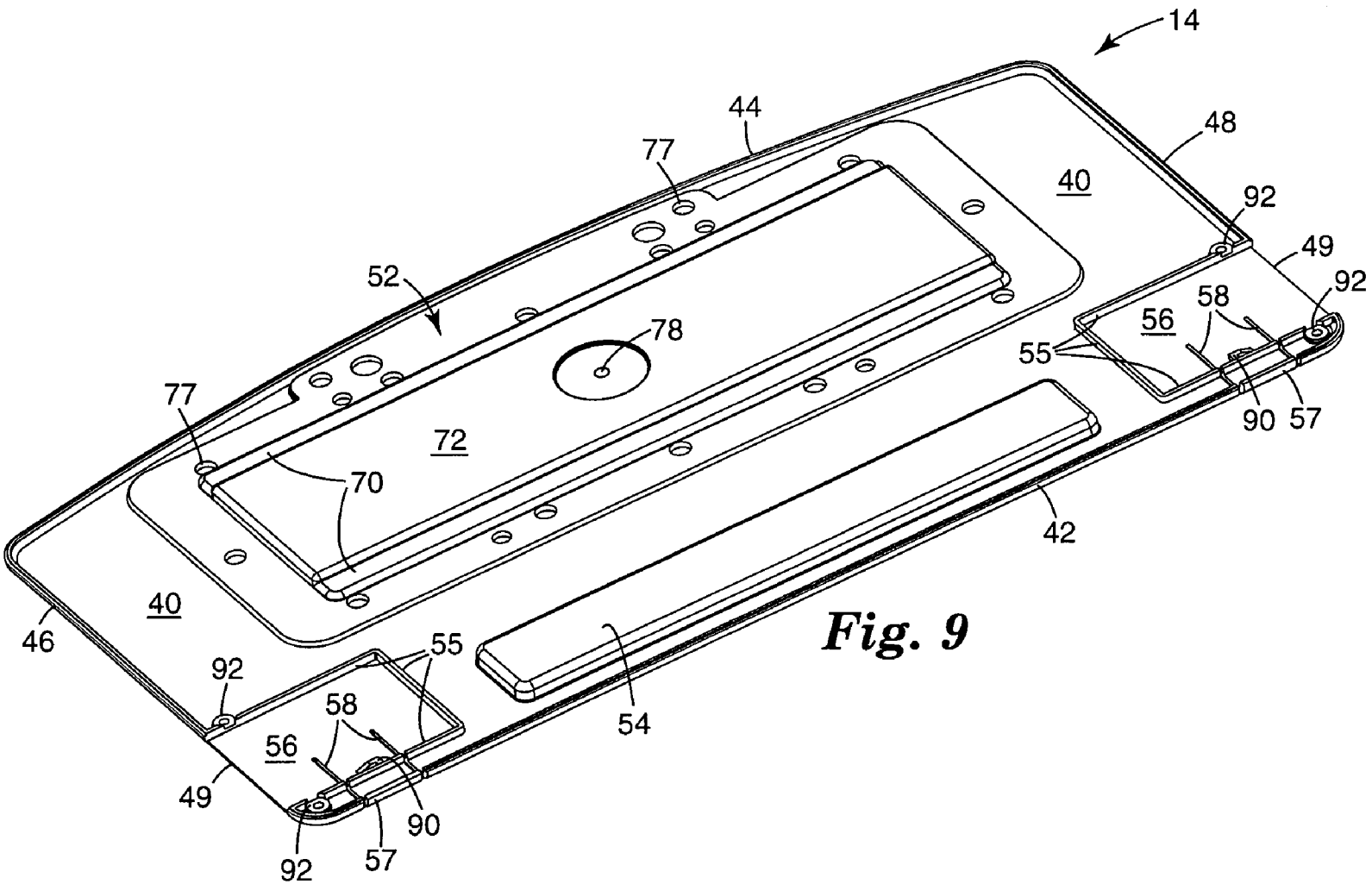
FIG. 9 is a perspective view of a top surface of a bottom plate of the keyboard tray platform in preferred embodiments of the invention.

FIG. 9 is a perspective view of the top surface 40 of the bottom plate 14. FIG. 9 more clearly illustrates the pockets 56 created by the inner walls 55 that extend up from the top surface 40 and that are accessed by the opening 49 created by a gap in the side walls 46 and 48. The openings 49 allow the mouse platform 24 to be inserted into one of the pockets 56 and be retained therein. A tab 90 extends into the pocket 56 from the inner wall 55 to secure the mouse platform 24. The tab 90 is preferably ramped along its outside surface to allow the mouse platform to slide over the top of the tab 90 when it is inserted into the pocket 56 (the tab 90 actually moves out of the way of the mouse platform 24, relying on the flexibility of the release lever 57 upon which the tab 90 is mounted). A pair of through holes 92 are also provided on each side of the opening 49 to each pocket 56. The through holes 92 correspond with sockets 80 that extend down from the bottom surface 31 of the top plate 12. Fasteners 75 can then be secured from the bottom surface 41 of the bottom plate 14, through the through holes 92 and into the corresponding sockets 80. The fasteners 75 extending through the through holes 92 provide extra strength at the opening 49 of the pockets 56 because of the stress placed upon the pockets 56 and thus the bottom plate 14 when the mouse platform 24 is connected and disconnected to the adjustable keyboard tray 10. Otherwise, without the reinforced connections, the stress and pressure placed on the bottom plate 14 at the pockets 56 may pull apart or separate the top and bottom plates 12 and 14 after a period of time.

Figure 10:
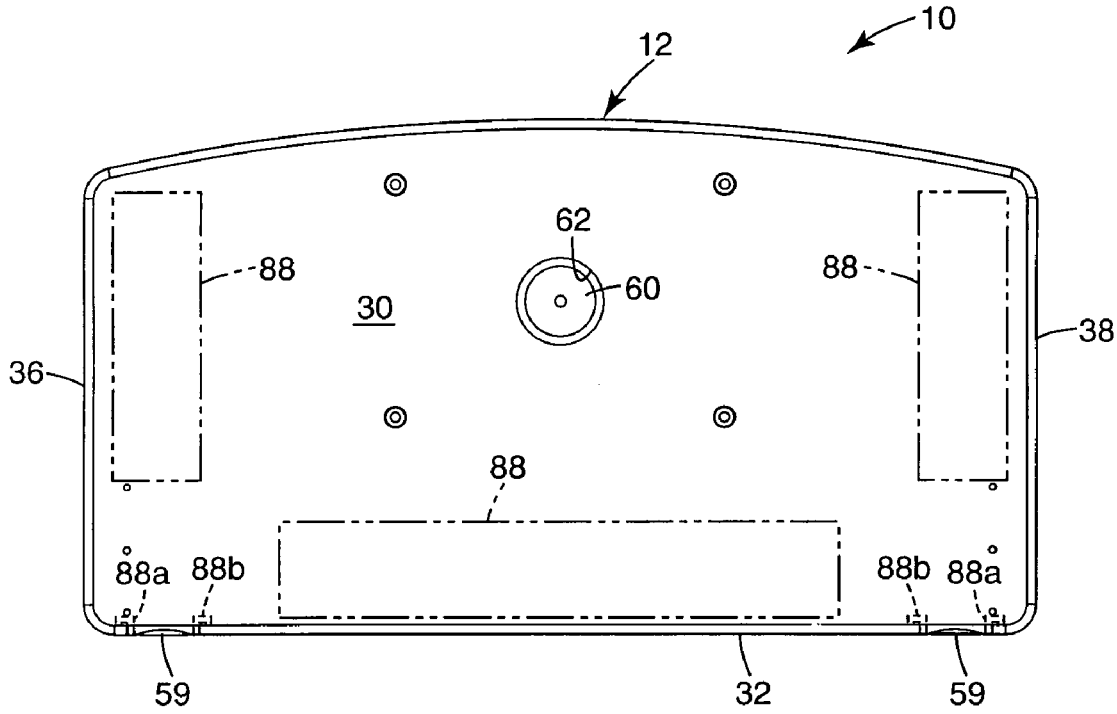
FIG. 10 is a top plan view of the keyboard tray platform of the preferred embodiments, illustrating the preferred locations to ultrasonically weld the top and bottom plates together.

FIG. 10 is a top view of the adjustable keyboard tray 10. In FIG. 10, the broken lines correspond to the broken lines illustrated in FIG. 8 and hence, identify generally the locations that the top and bottom plates 12 and 14, respectively, are ultrasonically welded together. As can be seen in FIG. 10, the designated areas for ultrasonic welding provide enough surface area to create a sufficient bond between the top and bottom plates 12 and 14 that comprise the adjustable keyboard tray 10. The designated areas for ultrasonic welding are also sufficiently spaced from the outer edges created by the side walls 32–38 to avoid any damage along the outer edges.

Figure 11:
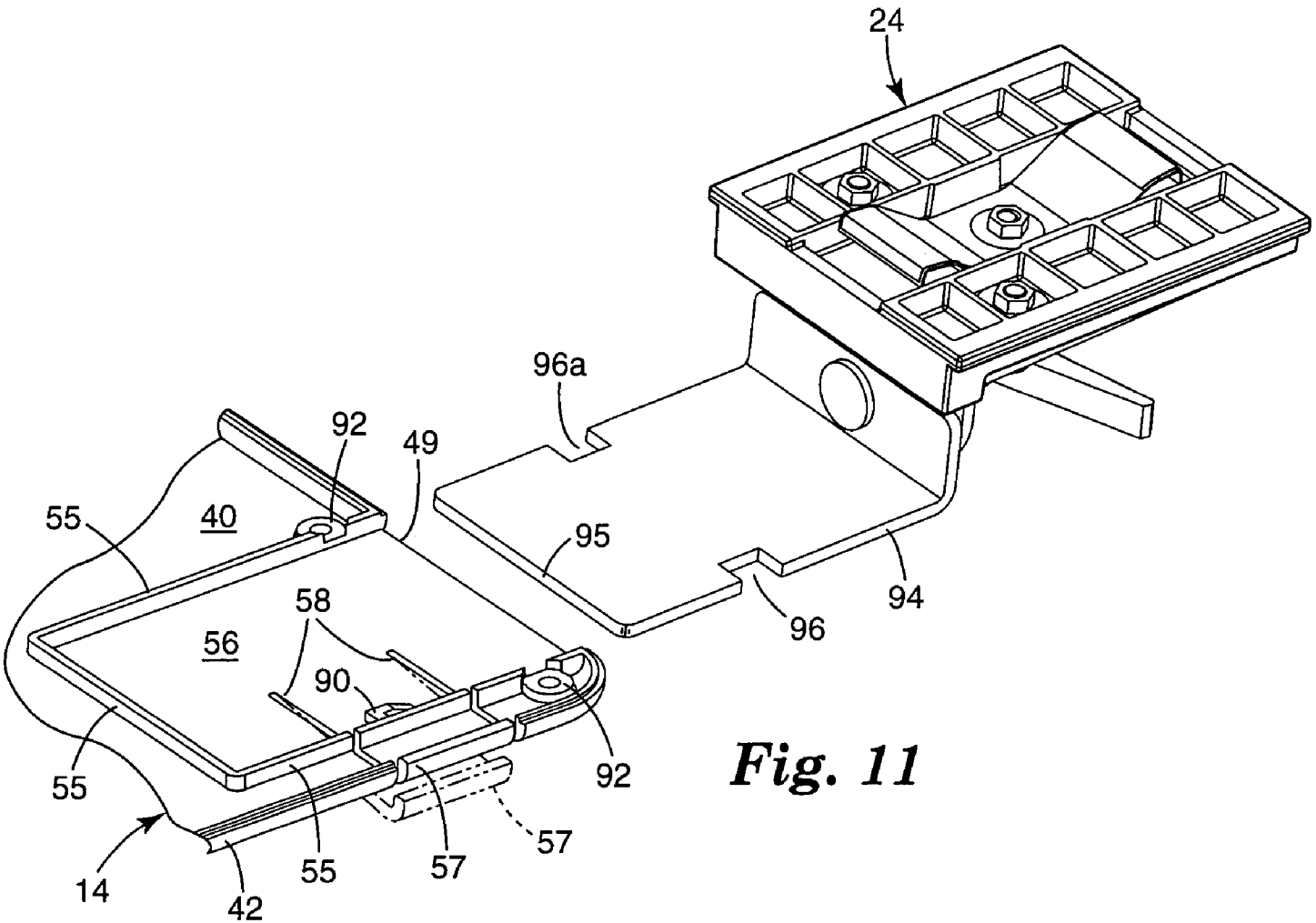
FIG. 11 is an exploded, partial view of a front, right corner of the bottom plate and an associated mouse platform.

FIG. 11 is a view of the right front corner of the bottom plate 14 and the mouse platform 24 with its mousing surface removed. FIG. 11 more clearly illustrates how the mouse platform 24 is preferably secured into and removed from each of the pockets 56. While only the right pocket 56 is illustrated in FIG. 11, the pockets 56 are preferably symmetrical and thus the left pocket 56 operates in the same manner.

One method and apparatus for attaching a mouse platform to a keyboard tray is described in U.S. Pat. No. 5,823,487. However, known techniques of attaching the mouse platform 24 are limited to surface mounting either the mouse platform 24 itself to the keyboard tray or surface mounting a pocket to the keyboard tray so that the mouse platform 24 can then be secured within the pocket. The result with either technique is surface mounting that again creates undesirable edges and corners.

To maintain a generally continuous smooth outer surface for the adjustable keyboard tray 10, the pocket 56 is preferably created within the cavity 50 by inner walls 55. In this manner, a bracket 94 of the mouse platform 24 can be inserted though the opening 49 and into the pocket 56. As the bracket 94 is inserted into the pocket 56, its front edge 95 contacts the ramped tab 90 to assist in the insertion of the bracket 94. As the bracket 94 slides over the ramped tab 90, it causes the release lever 57 to displace downward as illustrated in phantom and thereby allows the bracket 94 to be completely inserted into the pocket 56. The release lever 57, as part of the bottom plate 14, is formed from a polymer. However, the polymer used to create the release lever 57 and the bottom plate 14 has sufficient flexibility to permit the downward displacement of the release lever 57, yet has sufficient rigidity to prevent significant defection or bounce of the adjustable keyboard tray 10 during use.

As the bracket 94 is inserted, it will reach a point where a cutout 96 in the bracket 94 is aligned with the tab 90. At that point, the tab 90 and release lever 57 will return or spring back to their normal positions and the tab 90 will be received in the cutout 96, thereby locking the mouse platform 24 to the adjustable keyboard tray 10. The bracket 94 is thus secured within the cavity 50 maintaining a smooth outer surface across the adjustable keyboard tray 10.

To remove the mouse platform 24 from the adjustable keyboard tray 10, the bracket 94 has to be removed from the pocket 56. This is easily accomplished by depressing the release lever 57 downward (as shown in phantom), which in turn removes the tab 90 from the cutout 96 and thereby allows bracket 94, and hence the mouse platform 24, to be laterally withdrawn from the pocket 56. A cutout **96*a* is also placed in the bracket 94 opposite the cutout 96. The cutout 96*a* allows the mouse platform 24 to be re-oriented (rotated 180°) from its depiction in FIG. 11. This allows insertion of the bracket 94 and the mouse platform 24 into the pocket 56 through the opening 49 in the side wall 46 on the left side of the keyboard tray 10. Thus, the keyboard tray 10** can accommodate either left or right handed mouse users.

Figure 12:
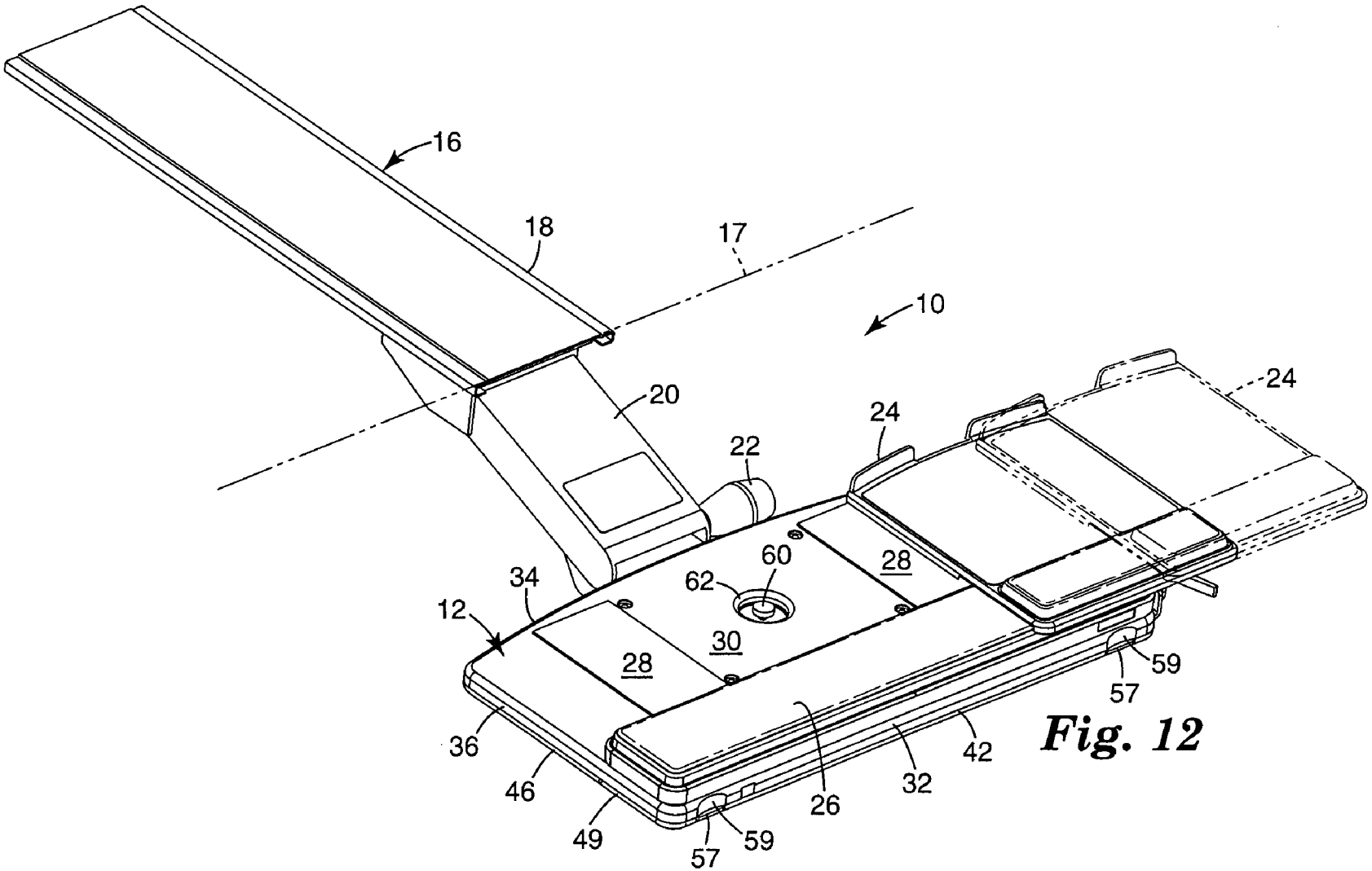
FIG. 12 is a perspective view of one of the preferred embodiments of the invention, illustrating lateral movement of the mouse platform relative to the keyboard tray platform.

FIG. 12 illustrates that the mousing surface of the mouse platform 24 can also be moved in a lateral direction. The mousing surface can be positioned over the top of the adjustable keyboard tray 10, such as when it is in a stored position or when access to the number pad on the keyboard is not needed. Alternatively, the mousing surface can be laterally extended away from the adjustable keyboard tray 10 when the keyboard is in use. The ability to laterally slide the mouse platform relative to the keyboard platform 10 has been previously described in U.S. Pat. No. 5,823,487.

The adjustable keyboard tray 10 thus provides an easier and more convenient and comfortable manner of supporting a keyboard that interfaces with a user to operate a computer. The keyboard tray 10 utilizes recessed areas and inner pockets to maintain a substantially smooth outer surface. The keyboard tray 10 also allows lateral movement to maintain proper positioning of the keyboard placed on the adjustable keyboard tray 10 with respect to the computer monitor. Lateral movement of the adjustable keyboard tray 10 is accomplished by pulling the adjustable keyboard tray 10 out from under the horizontal surface to an extended position. The thumb screw 60 is then loosened to allow the slidable mounting plate 66 to slide along the channels created between the retaining bracket 68 and the rails 70. Once the adjustable keyboard tray 10 is repositioned to the desired location, the user merely tights the thumb screw 60 down against the slidable mounting plate 66 securing the adjustable keyboard tray 10 in place with respect to the mounting bracket 16.

Although the present invention has been described with reference to preferred embodiments, workers skilled in the art will recognize that changes may be made in form and detail without departing from the spirit and scope of the invention. All patents referred to herein are incorporated by reference.

The invention claimed is:

1. An adjustable keyboard tray for use with a center mount bracketing mechanism that is secured to and translates in and out from a horizontal surface, the adjustable keyboard tray comprising:

a top plate made of polymeric material;

a bottom plate made of polymeric material that is secured to the top plate; and a mounting plate that secures the adjustable keyboard tray to the bracketing mechanism, wherein the mounting plate is secured to the adjustable keyboard tray by a retaining bracket, such that the adjustable keyboard tray can slide in a lateral direction substantially perpendicular to the direction of translation by the bracketing mechanism.

2. The adjustable keyboard tray of claim 1, wherein the retaining bracket is mounted to a recessed mounting area formed along a bottom surface of the bottom plate creating a channel therebetween that secures the mounting plate therein and allows the mounting plate to slide thereon, the retaining bracket including a central opening through which the mounting bracket is mounted to the bracketing mechanism and maintaining a substantially smooth outer bottom surface of the adjustable keyboard tray.

3. The adjustable keyboard tray of claim 2, and further comprising:

a thumb screw aligned to contact and lock the mounting plate in place with respect to the adjustable keyboard tray to prevent lateral movement of the adjustable keyboard tray with respect to the bracketing mechanism.

4. The adjustable keyboard tray of claim 1, wherein the top and bottom plates are secured together by ultrasonic welding.

5. An adjustable keyboard tray for use with a center mount bracketing mechanism that is secured to and translates in and out from a horizontal surface, the adjustable keyboard tray comprising:

a top plate made of polymeric material;

a bottom plate made of polymeric material that is secured to the top plate; and a mounting plate that secures the adjustable keyboard tray to the bracketing mechanism, wherein the mounting plate is secured to a bottom surface of the bottom plate of the adjustable keyboard tray in a recessed mounting area of the bottom plate to maintain a substantially smooth outer surface along the bottom plate.

6. The adjustable keyboard tray of claim 5 or claim 1, wherein a cavity is formed between the top and the bottom plates.

7. The adjustable keyboard tray of claim 6, wherein the top and the bottom plates include a series of inner walls along their opposed facing surfaces within the cavity.

8. The adjustable keyboard tray of claim 7, wherein the top plate and the bottom plate are ultrasonic welded along a set of the inner walls.

9. The adjustable keyboard tray of claim 7, wherein the series of inner walls within the cavity creates a pocket along a side of the adjustable keyboard tray that is aligned with an opening through the side of the adjustable keyboard tray to receive and secure therein a mouse bracket which supports a mouse platform.

10. The adjustable keyboard tray of claim 9, wherein the mouse bracket is releasably secured in the pocket by a tab which extends out from one of the inner walls that creates the pocket and is received in a slot on the mouse bracket.

11. The adjustable keyboard tray of claim 5, wherein the top and bottom plates are secured together by ultrasonic welding.

12. An adjustable keyboard tray for use with a bracketing mechanism that is secured to and translates in and out from a horizontal surface, the adjustable keyboard tray comprising:

a top plate made of polymeric material;

a bottom plate made of polymeric material that is secured to the top plate;

a cavity between the top plate and the bottom plate;

a series of inner walls that extend from the top and the bottom plates along their opposed facing surfaces, wherein the inner walls create an inner pocket along a side of the adjustable keyboard tray;

an opening along the side the adjustable keyboard tray that is aligned with the pocket to provide access therein;

a mouse bracket that supports a mouse platform, wherein the mouse bracket is inserted into the opening and is received and secured in the pocket; and a mounting plate that secures the adjustable keyboard tray to the bracketing mechanism, wherein the mounting plate is secured to a bottom surface of the bottom plate of the adjustable keyboard tray in a recessed mounting area of the bottom plate to maintain a substantially smooth outer surface along the bottom plate.

13. An adjustable keyboard tray for use with a bracketing mechanism that is secured to and translates in and out from a horizontal surface, the adjustable keyboard tray comprising:

a top plate made of polymeric material;

a bottom plate made of polymeric material that is secured to the top plate;

a cavity between the top plate and the bottom plate;

a series of inner walls that extend from the top and the bottom plates along their opposed facing surfaces, wherein the inner walls create an inner pocket along a side of the adjustable keyboard tray;

an opening along the side the adjustable keyboard tray that is aligned with the pocket to provide access therein;

a mouse bracket that supports a mouse platform, wherein the mouse bracket is inserted into the opening and is received and secured in the pocket; and a mounting plate that secures the adjustable keyboard tray to the bracketing mechanism, wherein the mounting plate is secured to the adjustable keyboard tray by a retaining bracket, such that the adjustable keyboard tray can slide in a lateral direction substantially perpendicular to the direction of translation by the bracketing mechanism.

14. The adjustable keyboard tray of claim 12 or claim 13, wherein the mouse bracket is releasably secured in the pocket by a tab which extends out from one of the inner walls that creates the pocket and is received in a slot on the mouse bracket.

15. The adjustable keyboard tray of claim 13, wherein the retaining bracket is mounted to a recessed mounting area formed along a bottom surface of the bottom plate creating a channel therebetween that secures the mounting plate therein and allows the mounting plate to slide thereon, the retaining bracket including a central opening through which the mounting bracket is mounted to the bracketing mechanism and maintaining a substantially smooth outer bottom surface of the adjustable keyboard tray.

16. The adjustable keyboard tray of claim 15, and further comprising:

a thumb screw aligned to contact and lock the mounting plate in place with respect to the adjustable keyboard tray to prevent lateral movement of the adjustable keyboard tray with respect to the bracketing mechanism.

17. The adjustable keyboard tray of claim 13, wherein the top plate is secured to the bottom plate by ultrasonic welding.

18. An adjustable keyboard tray for use with a center mount bracketing mechanism that is secured to and translates in and out from a horizontal surface, the adjustable keyboard tray comprising:

a top plate made of polymeric material;

a bottom plate made of polymeric material that is secured to the top plate;

a retaining bracket that is secured to the bottom plate in a manner that creates a channel between the retaining bracket and the bottom plate;

a central opening in the retaining bracket; and a mounting plate that is secured in the channel between the retaining bracket and the bottom plate, wherein the mounting plate secures the adjustable keyboard tray to the bracketing mechanism through the central opening in the retaining bracket and slides along the channel such that the adjustable keyboard tray can slide in a lateral direction substantially perpendicular to the direction of translation by the bracketing mechanism, wherein the retaining bracket is mounted to a recessed mounting area formed along a bottom surface of the bottom plate to maintain a substantially smooth outer bottom surface of the adjustable keyboard tray.

19. The adjustable keyboard tray of claim 18, wherein the top plate is secured to the bottom plate by ultrasonic welding along a set of the inner walls.

20. The adjustable keyboard tray of claim 18, and further comprising:

a thumb screw aligned to contact and lock the mounting plate in place with respect to the adjustable keyboard tray to prevent lateral movement of the adjustable keyboard tray with respect to the bracketing mechanism.

21. The adjustable keyboard tray of claim 18, wherein a cavity is formed between the top and the bottom plates.

22. The adjustable keyboard tray of claim 21, wherein the top and the bottom plates include a series of inner walls along their opposed facing surfaces within the cavity.

23. The adjustable keyboard tray of claim 22, wherein the top plate and the bottom plate are ultrasonic welded along a set of the inner walls.

24. The adjustable keyboard tray of claim 22, wherein the series of inner walls within the cavity creates a pocket along a side of the adjustable keyboard tray that is aligned with an opening through the side of the adjustable keyboard tray to receive and secure therein a mouse bracket which supports a mouse platform.

25. The adjustable keyboard tray of claim 24, wherein the mouse bracket is releasably secured in the pocket by a tab which extends out from one of the inner walls that creates the pocket and is received in a slot on the mouse bracket.

26. A method of repositioning an adjustable keyboard tray in a lateral direction substantially perpendicular to a center mount bracketing mechanism that is secured to a horizontal surface at one end and the adjustable keyboard tray at an opposite end, the method comprising:

pulling the adjustable keyboard out from under the horizontal surface, causing the bracketing mechanism to translate out from under the horizontal surface, wherein the adjustable keyboard tray has a top and a bottom plate that are bonded together;

loosening a screw that passes through a through hole in the top plate and is retained in a threaded bore formed in the bottom plate, so that the screw does not prevent lateral movement of the adjustable keyboard tray;

repositioning the adjustable keyboard tray in the lateral direction until the adjustable keyboard tray is in a desired position; and tightening the screw by driving it through the threaded bore until it prevents lateral movement of the adjustable keyboard tray.

* * * * *